US008186903B2

(12) United States Patent
Makin et al.

(10) Patent No.: US 8,186,903 B2
(45) Date of Patent: May 29, 2012

(54) FASTENER ASSEMBLY

(75) Inventors: Ian Makin, Bristol (GB); Michael C Roberts, Bristol (GB)

(73) Assignee: Rolls-Royce PLC, London (GB)

( * ) Notice: Subject to any disclaimer, the term of this patent is extended or adjusted under 35 U.S.C. 154(b) by 579 days.

(21) Appl. No.: 12/292,247

(22) Filed: Nov. 14, 2008

(65) Prior Publication Data

US 2009/0162136 A1 Jun. 25, 2009

(30) Foreign Application Priority Data

Dec. 21, 2007 (GB) ..... 0725003.8

(51) Int. Cl.
*F04D 29/44* (2006.01)

(52) U.S. Cl. ..... 403/359.5; 403/11; 403/353; 415/209.3

(58) Field of Classification Search ..... 403/240, 403/320, 359.1, 359.5, 343, 11, 13, 14, 21, 403/353; 60/805; 415/209.3; 416/170 R, 416/204 R, 207, 209
See application file for complete search history.

(56) References Cited

U.S. PATENT DOCUMENTS

| | | | | | |
|---|---|---|---|---|---|
| 2,804,323 | A | * | 8/1957 | Morley | 416/204 R |
| 3,622,185 | A | * | 11/1971 | Rosan et al. | 403/316 |
| 3,970,398 | A | | 7/1976 | Wilson | |
| 4,193,741 | A | | 3/1980 | Briggs | |
| 4,606,671 | A | * | 8/1986 | Rasmussen | 403/359.5 |
| 5,356,236 | A | * | 10/1994 | Duboue | 403/359.6 |

FOREIGN PATENT DOCUMENTS

JP A-55107120 8/1980

* cited by examiner

*Primary Examiner* — Michael P Ferguson
(74) *Attorney, Agent, or Firm* — Oliff & Berridge, PLC

(57) ABSTRACT

The invention is related to a fastener assembly of the kind used to secure a gas turbine engine rotor disc assembly on a shaft in a situation which otherwise would required the use of a trapped nut. It thereby removes a design constraint limiting bore diameter of the disc assembly to permit access to a securing nut on the shaft, and avoids the use of a trapped nut. One of the rotors hubs is adapted to be mounted on the shaft and the securing nut is engaged with a thread on the shaft to trap the hub. In the improvement of the invention the hub is provided with an axial keyway through which the securing nut is passed into the limited access space. Once the shaft is engaged with the hub the nut is then engaged with the thread on the shaft and tightened using a special tool extending through the centre of the shaft. The tool is withdrawn after use. The nut may be undone and retrieved in an opposite operation.

7 Claims, 3 Drawing Sheets

FASTENER ASSEMBLY

FIELD OF INVENTION

The invention concerns a fastener assembly, particularly a fastener assembly for attaching to the end of a shaft an assembly that provides insufficient access to a securing nut on the shaft.

BACKGROUND

The fastener assembly of the invention is found especially useful in the field of gas turbine engine design and manufacture. In a traditional gas turbine engine design a rotor comprises a disc having a central cob or hub, a rim and a web between them, the blades are spaced apart around the rim. Originally the rotors were mounted on a drive shaft individually. Such arrangements tend to be heavy, difficult to balance, relatively easy but time-consuming to assemble and disassemble. Improved rotor designs in which several rotors are bolted or welded together into unitary drum like structures are easier to balance. The drum is then mounted on the drive shaft as a single unit, rather than as a plurality of individual rotors, using a fastener assembly such as a securing nut engaged with a threaded portion on the shaft butting against a shoulder on one of the rotor discs.

Essentially the design of the individual rotor stages retains a central hub, web and rim. Access requirements for mounting rotor drums on a shaft during initial assembly, repair and maintenance impose a minimum bore diameter on the inner circumference of the hub which translates into a significant weight penalty in order adequately to contain stresses in the rotor design. An alternative to increased bore sizes is to use a trapped nut, but this has a detrimental effect on engine assembly and maintenance, especially as self-locking nuts need to be replaced periodically in order to avoid loss of locking torque. As a result the rotor drum has to be split and then rejoined to allow replacement of the trapped nut leading to inevitable drawbacks as previously mentioned. The present invention is intended to address these problems by providing an alternative route for insertion and retrieval of the nut otherwise than through the central bore of the discs.

The invention is not limited to use in conjunction with gas turbine engines and may be utilised in other fastener assemblies that use a trapped nut.

SUMMARY

According to one aspect of the invention a fastener assembly for securing a shaft to a hub or the like comprises a hub having an internal bore formed with internal splines and a shoulder at one end, a hollow shaft formed with external splines and a screw threaded portion at its distal end, wherein when the splined portions of the shaft and hub are engaged an appropriately sized nut is screwed onto the threaded portion of the shaft to engage the shoulder on the hub thereby locking together the hub and the shaft, characterised in that to permit assembly when the distal end of the shaft is not directly accessible to allow the nut to be tightened, the nut has dimensions which permit it to be capable of passing through the hub.

For the purpose of assembly in situations where the distal end of the shaft is inaccessible it is preferred the bore of the hub is formed with an internal keyway the dimensions of which permit the nut to pass through the hub. The width of the keyway in the hub and the axial length of the nut are chosen to permit the nut to pass sideways along the internal keyway in the hub.

According to another aspect of the invention the fastener assembly includes a tool adapted to pass through the hollow shaft and engage the nut, by use of which the nut may be engaged with the thread on the distal end of the shaft and tightened.

According to a further aspect of the invention a method of assembling a fastener for securing a shaft to a hub or the like wherein the hub and the shaft are splined together and secured by a nut on the shaft engaged with a shoulder on the hub, the method comprising the steps of: forming a axially extending keyway in the splined bore of the hub, passing the nut along the keyway in the hub, mounting the shaft on the hub by engaging splined portions of the shaft and hub, and securing the shaft to the hub by engaging the nut with the threaded portion of the shaft and screwing the nut to engage the shoulder on the hub. Preferably the shaft is formed hollow and a tool for screwing the nut along the threaded portion of the shaft extends through the hollow bore of the shaft.

BRIEF DESCRIPTION OF DRAWING

The invention will now be described in greater detail with reference to the accompanying drawings, in which.

DETAILED DESCRIPTION

Figure 1:
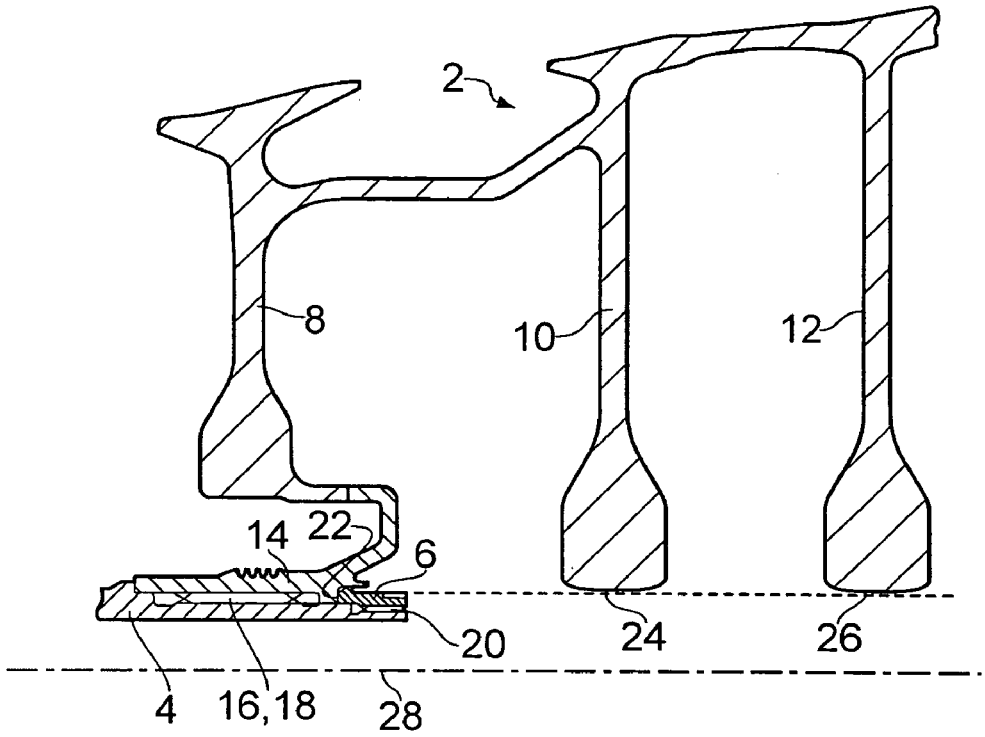
FIG. 1 Prior Art
FIG. 1 is a section view on the centre axis of a part of a rotary assembly according to the prior art in which sufficient clearance is available around the axis line for easy assembly.

Referring now to FIG. 1 of the drawings there is shown a part view of a gas turbine engine bladed disc assembly, generally indicated at 2, which is splined to a drive shaft 4 and secured by a ring nut 6. The bladed disc 2 assembly comprises at least three stages of discs, in the figure three discs 8, 10, 12 are shown, which are joined together to form an integral unit. Drive shaft 4 is attached to hub 14 of first stage disc 8 by means of a splined joint, in which internal splines 16 formed on the inside of the bore of hub 14 are engaged with complementary, external splines 18 towards the distal end of shaft 4. Shaft 4 and hub 14 are secured by ring nut 6 which is engaged with a threaded portion 20 and tightened up to shoulder 22 on the hub to secure the shaft and hub together. The hub 14 is formed integrally with or is joined to the inner circumference of the first stage turbine disc 8. In this known assembly the dimensions of the inner circumferences 24, 26 of the second and third stage discs 10, 12—there may be more discs—in particular the radial clearance from the centre line 28 allow the ring nut 6 to be offered up to the threaded, distal portion 20 of shaft 4 through the central bore of the disc assembly 2, that is from the right hand side of the drawings. In this arrangement it is not difficult to access the securing nut 16 directly and to tighten it in order to secure the shaft 4 and disc hub 14 together, or extract the nut for repair and maintenance operations.

Figure 2:
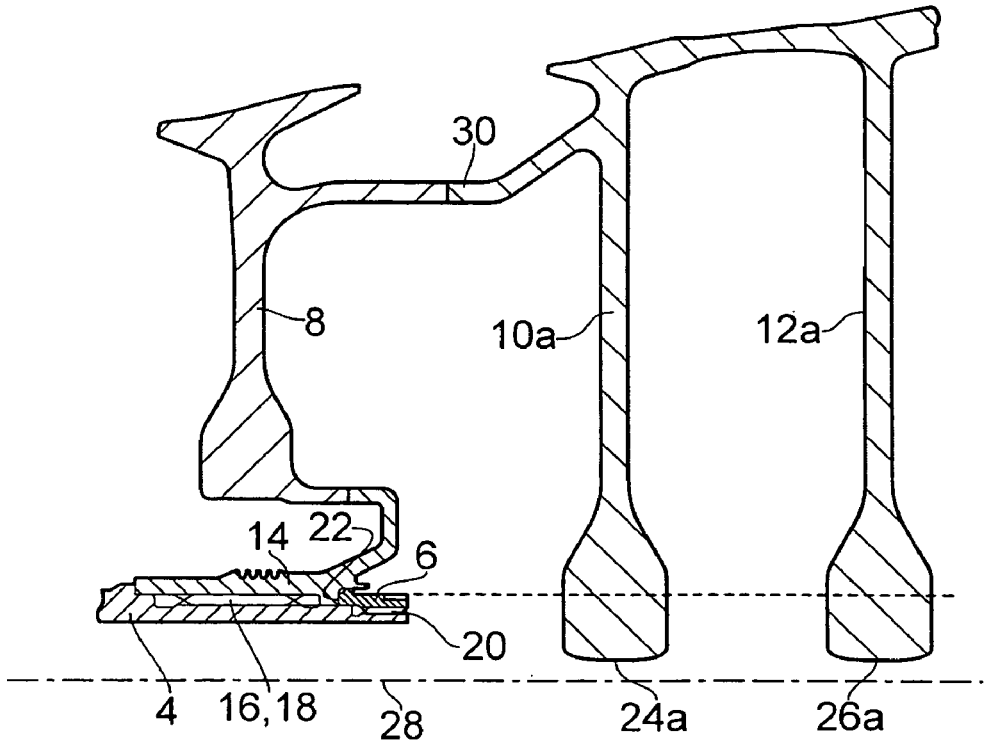
FIG. 2 Prior Art
FIG. 2 is a section view on the centre axis of a similar rotary assembly with more restricted access on the centre line.

In FIG. 2 like parts carry like references. The discs 10*a*, 12*a* are of a design modified for greater weight efficiency in which the radii of the inner circumferences 24*a*, 26*a* of the discs is smaller compared to the corresponding dimensions of the arrangement depicted the view of FIG. 1. Unfortunately the inner circumferences 24*a*, 26*a* are too small to permit ring nut 6 to pass along the centre line 28 to be engaged with the thread on shaft 4. In order to overcome this drawback, in this arrangement the disc assembly is joined and separated at joint line 30 between the first and second stage discs 8 and 10*a* for initial assembly and subsequent disassembly for repair and maintenance. The discs 8, 10*a* are welded together at joint line 26 after the shaft 4 has been secured to the hub 14 by ring nut 6. This is not a preferred procedure, not least because it creates potential balance and joint quality problems. In accordance with the present invention the preferred solution to this problem is a modified fastener arrangement illustrated in a general view by FIG. 3 and in greater detail in FIG. 4, FIGS. 5*a*, 5*b*, 5*c*, and FIGS. 6*a* and 6*b*.

Figure 3:
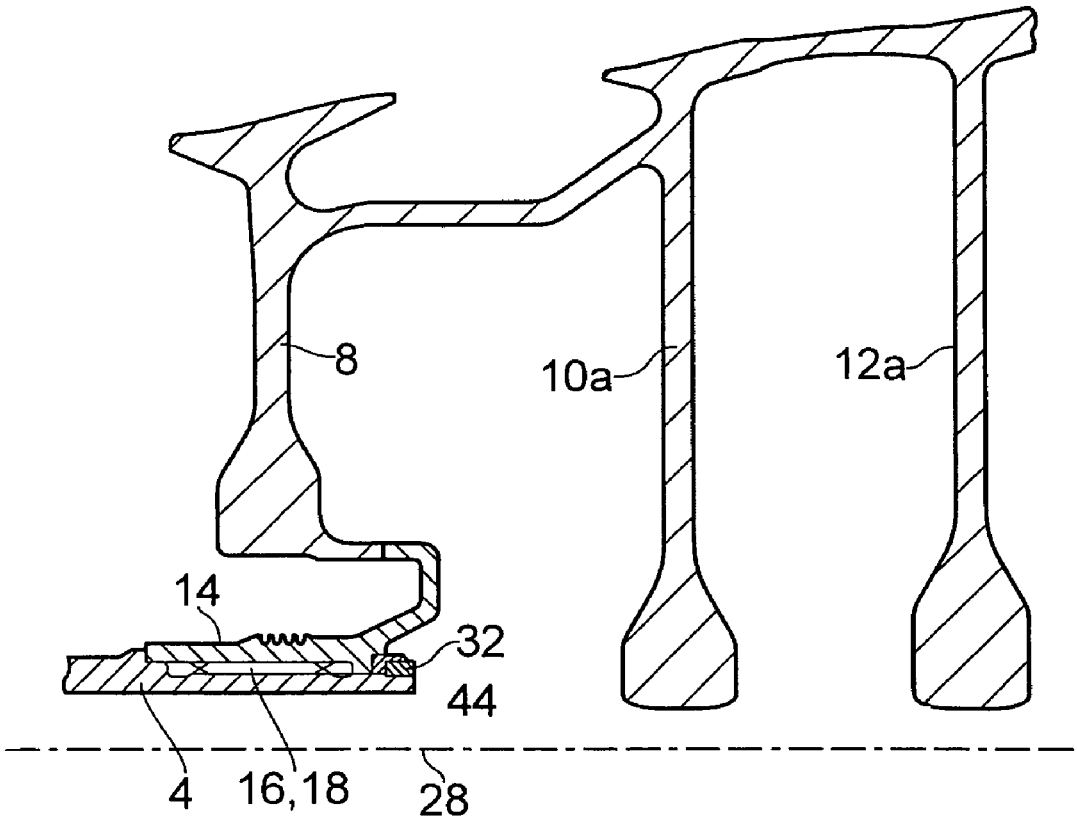
FIG. 3 is a section view on the centre axis of the rotary assembly of FIG. 2 adapted according to the present invention.
Figure 4:
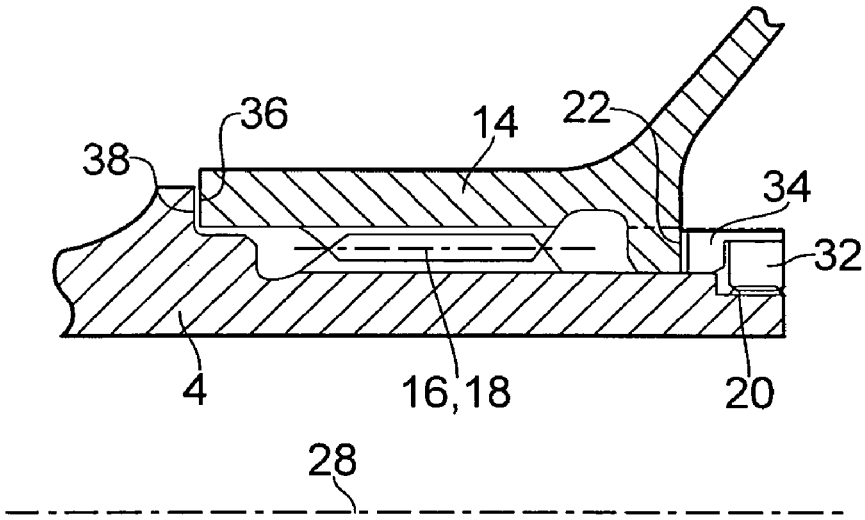
FIG. 4 is an enlarged view of the shaft to hub mounting and securing nut of the assembly of FIG. 3.

Comparison of the arrangements show in FIGS. 2 and 3 immediately reveals that the fastener assembly for securing shaft 4 to a hub 14 includes a different design of the securing nut. Shown in more detail in FIG. 4 the fastener assembly comprises a ring nut 32, preferably in conjunction with a cup washer 34, engaged with the threaded portion 20 at the distal end of shaft 4 and tightened to abut the shoulder 22 on hub 14. When securing nut 32 is in position against shoulder 22 the opposite end 36 of hub 14 is urged against a second shoulder 38 formed on shaft 4. As previously mentioned because of the reduced diameter of the inner circumferences 24*a*, 26*a* of discs 10*a*, 12*a* it is not possible to offer the nut 32 and washer 34 into position to engage the threaded end of shaft 4 through the centre bore of the discs.

Figure 5A:
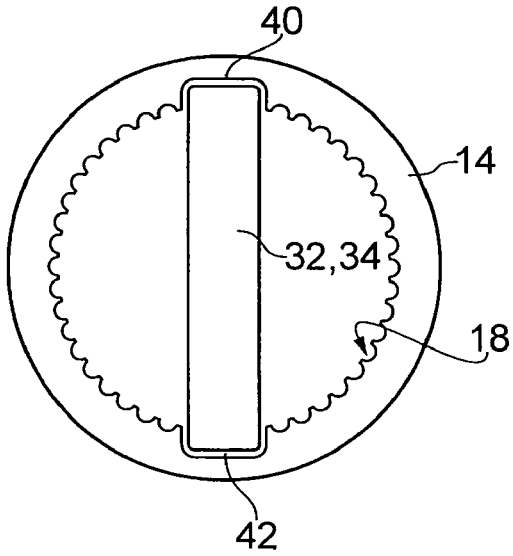
FIGS. 5*a*, 5*b* & 5*c* are detail views showing the hub, keyway and securing nut.
Figure 5B:
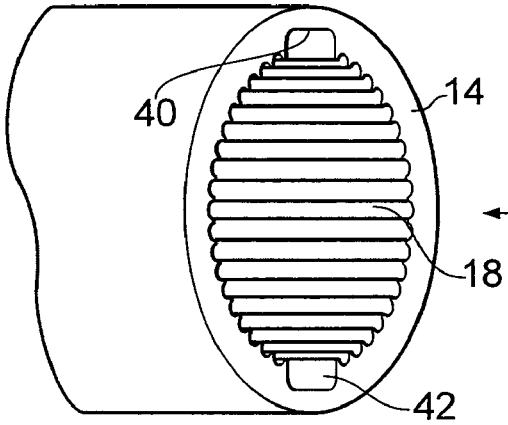
Figure 5C:
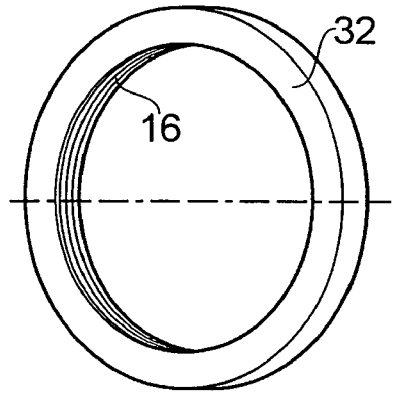

The solution to this problem, as illustrated in FIGS. 5*a*, 5*b* and 5*c* involves passing the securing nut 32, or the nut and washer combination 32, 34 through the hub 14. In accordance with one aspect of the invention the method of assembling a fastener for securing the shaft 4 to hub 14 includes the steps of forming an axially extending keyway 40, 42 in the splined bore of the hub 14, passing the nut 32, or nut and washer 32, 34 along the keyways 40, 42 into the inaccessible space 44 (FIG. 3) before mounting the shaft 4 in the hub 14 by engaging the splined portions 16, 18. Once the shaft and hub are in position the nut 32 is engaged with the threaded portion 20 of the shaft 4 and is screwed onto the shaft until the nut 32, or the washer 34, engages the shoulder 22 on the hub 14.

Figure 6:
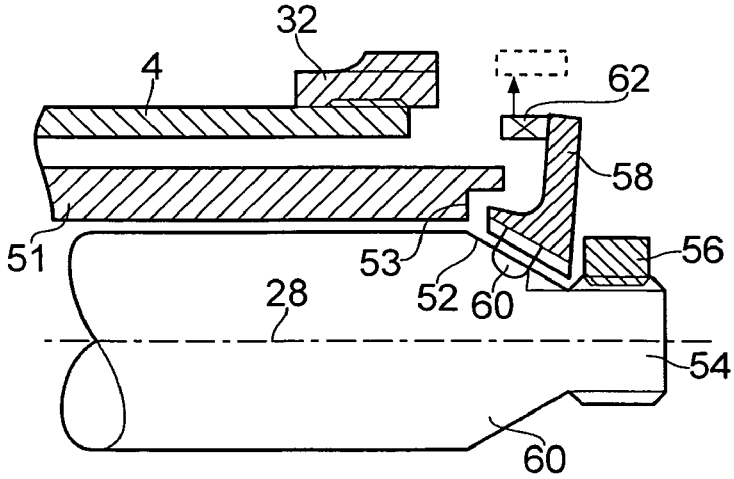
FIG. 6 illustrates a tool for tightening the securing nut of the assembly.

A tool for use in this method of assembly is illustrated in FIG. 6 of the drawings. The tool comprises an arbour 50 inside a sleeve 51 which will pass along the internal bore of the shaft 4. The distal end of the arbour 50 is formed with a frusto-conical shape 52 leading to a reduced diameter portion 54 which is threaded to carry a screw nut 56. A plurality of segments 58 is mounted on the frusto-conical face 52 on anti-rotation keys 60. The arrangement of segments, 58, keys 60 and nut 56 is such that as the nut 56 is turned and travels along its threaded portion on the arbour 50 the segments are caused to travel up (or down according to the direction of rotation) the frusto-conical face 52 until they engage a rebate 53 on outer sleeve 51. The outermost parts 62 of the segments 58 comprise dogs adapted to engage castellations formed on the securing nut 32. Once engaged with the securing nut 32 the whole arbour assembly is turned, in the manner of a wrench or socket spanner, in order to tighten the nut 32 on the shaft 4. Afterwards the dogs 62 are disengaged form the securing nut 32, the arbour 50 is turned back relative to sleeve 51 retracting the segments 58 towards the bottom of the frusto-conical face to allow the tool to be withdrawn through the shaft 4. This tool is suitable for use during initial assembly and for dismantling and reassembling the bladed disc assembly during repair and overhaul. The tool is withdrawn after use. The nut may be undone and retrieved in an opposite operation.

The invention claimed is:

1. A fastener assembly comprising:

a hub having an internal bore having a proximal end and a distal end and formed with axially extending internal splines disposed between the proximal and distal ends and a shoulder disposed at the distal end, the bore being formed with an internal keyway axially extending from the proximal end through the shoulder;

a hollow shaft having an internal bore, an outer surface of the shaft formed with axially extending external splines disposed adjacent a distal end of the shaft for matingly engaging with the internal splines of the hub, and a screw threaded portion at the distal end of the shaft; and a nut having an axial length sized to enable the nut to pass sideways completely through the keyway from the proximal end of the hub through the shoulder prior to insertion of the shaft into the bore of the hub;

wherein when the shaft is received within the bore of the hub such that the external splines of the shaft completely engage with the internal splines of the hub, the nut is axially aligned with and screwed onto the threaded portion of the shaft such that the nut engages the shoulder on the hub thereby locking together the hub and the shaft;

wherein the internal bore of the shaft is sized to receive a tool which extends through the internal bore of the shaft to axially align and rotate the nut, so as to permit assembly when the distal end of the shaft is not directly accessible to allow the nut to be tightened.

2. A fastener assembly as claimed in claim 1, further comprising:

a tool adapted to pass through the hollow shaft and engage the nut, such that the nut is screwed onto the shaft and tightened.

3. A fastener assembly as claimed in claim 2, wherein the tool comprises an arbour inside a sleeve, a distal end of the arbour having a frusto-conical face leading to a reduced diameter portion that carries a plurality of driving elements for engaging the nut and screwing the nut onto the shaft.

4. A fastener assembly as claimed in claim 3, wherein the reduced diameter portion is threaded and carries a screw nut that may be translated to move the plurality of driving elements along the frusto-conical face.

5. A method of assembly a fastener for securing a shaft to a hub, the method comprising the steps of:

providing a hub having an internal bore having a proximal end and a distal end and formed with axially extending internal splines disposed between the proximal and distal ends and a shoulder disposed at the distal end;

forming an internal keyway in the bore which axially extends from the proximal end through the shoulder;

providing a hollow shaft having an internal bore, an outer surface of the shaft formed with axially extending external splines disposed adjacent a distal end of the shaft for matingly engaging with the internal splines of the hub, and a screw threaded portion at the distal end of the shaft;

providing a nut having an axial length sized to enable the nut to pass sideways through the keyway;

passing the nut sideways completely through the keyway from the proximal end of the hub through the shoulder;

mounting the shaft within the bore of the hub such that the external splines of the shaft completely engage with the internal splines of the hub;

extending a tool through the internal bore of the shaft to axially align and rotate the nut, so as to permit assembly when the distal end of the shaft is not directly accessible to allow the nut to be tightened; and using the tool to secure the shaft to the hub by axially aligning and screwing the nut onto the threaded portion of the shaft such that the nut engages the shoulder on the hub thereby locking together the hub and the shaft.

6. A method as claimed in claim 5, wherein the tool comprises an arbour inside a sleeve, a distal end of the arbour having a frusto-conical face leading to a reduced diameter portion that carries a plurality of driving elements for engaging the nut and screwing the nut onto the shaft.

7. A method as claimed in claim 6 wherein the reduced diameter portion is threaded and carries a screw nut that may be translated to move the plurality of driving elements along the frusto-conical face.

* * * * *